United States Patent [19]

Lamar et al.

[11] Patent Number: 4,964,955

[45] Date of Patent: Oct. 23, 1990

[54] METHOD OF REDUCING PITCH IN PULPING AND PAPERMAKING OPERATIONS

[75] Inventors: Richard S. Lamar, Littleton; William E. Pratt, Englewood, both of Colo.; Kenneth E. Weber, North Hollywood, Calif.; Robert E. Roeder, Parker, Colo.

[73] Assignee: Cyprus Mines Corporation, Englewood, Colo.

[21] Appl. No.: 287,866

[22] Filed: Dec. 21, 1988

[51] Int. Cl.[5] ..... D21H 17/45; D21H 17/54

[52] U.S. Cl. ..... 162/164.6; 162/168.2; 162/181.6; 162/181.8; 162/199; 162/DIG. 4

[58] Field of Search ..... 162/168.2, 181.8, 199, 162/DIG. 4, 181.6, 181.7, 164.6

[56] References Cited

U.S. PATENT DOCUMENTS

| | | | |
|---|---|---|---|
| 2,795,545 | 6/1957 | Gluesenkamp | 252/28 |
| 2,795,567 | 6/1957 | Ruehrwein | 260/41 |
| 2,995,545 | 6/1957 | Glusenkamp | 162/168.5 |
| 3,052,595 | 9/1962 | Pye | 162/164 |
| 3,141,815 | 7/1964 | Manley | 162/164 |
| 3,801,433 | 4/1974 | Windle | 162/181 D |
| 4,070,236 | 1/1978 | Carrard | 162/164 R |
| 4,171,417 | 10/1979 | Dixon | 526/245 |
| 4,181,567 | 1/1980 | Riddell et al. | 162/168 NA |
| 4,210,488 | 7/1980 | Reuss et al. | 162/162 |
| 4,278,573 | 7/1981 | Tessler | 260/17.4 GC |
| 4,305,781 | 12/1981 | Langley et al. | 162/164 R |
| 4,313,790 | 2/1982 | Pelton et al. | 162/163 |
| 4,425,238 | 1/1984 | Degen et al. | 210/666 |
| 4,445,970 | 4/1984 | Post et al. | 162/135 |
| 4,643,801 | 2/1987 | Johnson | 162/164.1 |
| 4,749,444 | 6/1988 | Lorz et al. | 162/168.3 |
| 4,765,867 | 8/1988 | Dreisbach et al. | 162/72 |

FOREIGN PATENT DOCUMENTS

| | | | |
|---|---|---|---|
| 454036 | 1/1949 | Canada . | |
| 1168404 | 6/1984 | Canada . | |
| 0058622 | 8/1982 | European Pat. Off. | 162/168.2 |
| 0235893 | 9/1987 | European Pat. Off. | 162/181.8 |
| 7720510 | 2/1979 | France . | |
| 163298 | 12/1980 | Japan . | |

OTHER PUBLICATIONS

Louch et al, "The Role of Special Polyelectrolytes for the Solution of Operating Problems in Paper and Board Production", Paper Presented at U.K. Paper Ind. Tech. Assoc., N.D. Meeting Held on Nov. 7, 1985.

Rahman, et al., "Mechanism of Fines Retention by Polyethylene Oxide in Newsprint Type of Furnishes, Part I, Effect of Stock Variation", TAPPI Proceedings, 1986 Papermakers Conference, pp. 189–198.

(List continued on next page.)

*Primary Examiner*—Steve Alvo

*Attorney, Agent, or Firm*—Lyon & Lyon

[57] ABSTRACT

A method of and substances for reducing pitch in pulping and papermaking operations, particularly in furnishes made by mechanical pulping processes containing wood pulp in amounts greater than about 10% by weight, are disclosed. The method comprises adding to a pitch-containing furnish a stable, water dispersible particulate composite substance prepared by irreversibly adsorbing a water soluble cationic polymer, e.g., a poly(diallyldimethylammonium chloride), onto an essentially water insoluble particulate substrate, e.g., kaolin, thereby rendering the cationic polymer insoluble and immobile, the cationic polymer being sufficiently electropositive so that the particulate composite pitch control substance exhibits a zeta potential of at least about +30 mV, and preferably from about +60 mV to about +80 mV, the amount of the composite substance added to the furnish being effective to finely disperse pitch for removal as finely-dispersed pitch-containing aggregates in a paper sheet produced from said furnish.

Further improvements in pitch control can be achieved using these particulate composite pitch control substances together with alum and/or relatively high molecular weight alkylene oxide polymers, and other desirable effects, including improved fines retention, better drainage and lower waste treatment costs are also obtained when practicing this method.

27 Claims, 5 Drawing Sheets

OTHER PUBLICATIONS

Nichols, "The Use of Polyacrylamides to Improve the Retention and Drainage of Both Fibers and Fillers in Groundwood Sheets", TAPPI Proceedings, 1986, Papermakers Conference, pp. 181–188.

Weigl; et al., "The Function and Technological as Well as Economical Aspects of Pre-Treatment of Fillers for Groundwood Containing Printing Papers", Das Papier, 35, No. 10A, V-46-55 (1981).

Allen, "Mechanisms and Control of Pitch Deposition in Newsprint Mills", TAPPI, 63, No. 2, pp. 81–87 (1980).

C. H. Tay, "Application of Polymeric Flocculant in Newsprint Stock Systems for Fines Retention Improvement", TAPPI Journal, vol. 63, No. 6, pp. 63–66, Jun. 80.

Leung et al, "Flocculation of Paper Fines by Polyethyleneoxide", TAPPI Journal, vol. 70, No. 7, pp. 115–118, Jul. 1987.

Linhart et al., "Anionic Trash:Controlling Detrimental Substances", TAPPI Journal, vol. 70, No. 10, Begin p. 79 (1987).

CA Selects: Paper Additives, Issue 20, No. 111:99250b (Issue Jun. 20, 1989, p. 2; Al).

CA Selects: Paper Additives, Issue 20, No. 111:99251c (Issue Jun. 20, 1989, p. 2; A2).

Britt et al, "Electrophoresis in Paper Stock Suspensions as Measured by Mass Transport Analysis", TAPPI Journal, vol. 57, No. 12, pp. 81–84, Dec. 1974.

Britt et al, "New Methods for Monitoring Retention", TAPPI Journal, vol. 59, No. 2, pp. 67–70, Feb. 1976.

Pelton et al, "A Survey of Potential Retention Aids for Newsprint Manufacture", Paprican, Jul. 1978.

Pelton et al, "Novel Dual-Polymer Retention Aids for Newsprint and Groundwood Specialties", TAPPI Journal, vol. 64, No. 11, Nov. 1981.

% PITCH REMOVED
LBS. OF ADDITIVE/TON OF NEWSPRINT
0
20
40
60
80
100
A
B
C
D
E
F
G
H

METHOD OF REDUCING PITCH IN PULPING AND PAPERMAKING OPERATIONS

FIELD OF THE INVENTION

This invention relates to pitch control in both pulping and papermaking operations, especially, and for the first time in a commercially successful manner, in furnishes made by mechanical pulping processes which contain groundwood pulp in amounts greater than about 10% by weight based on the total dry weight of pulp in the furnish. This invention also relates to pitch control in mills which utilize other kinds of furnishes, e.g., ones containing bleached or unbleached sulfate or Kraft pulp, or bleached or unbleached sulfite pulp, and especially furnishes in which groundwood pulp is present in amounts greater than about 10% by weight. More particularly, this invention relates to preventing the buildup of nuisance deposits caused by resinous materials such as pitch and pitch colloids on papermaking equipment and to the dispersion of such materials in the paper being made in the form of tiny, non-harmful aggregated or agglomerated particles instead of larger, harmful globs. This invention also relates to particular combinations of substances for use in pitch control processes carried out in accordance with this invention and to methods of preparing such combinations.

BACKGROUND OF THE INVENTION

Wood is pulped to produce papermaking fibers by any of several different processes, each of which is designed to take maximum advantage of the characteristics of the particular type of wood fibers obtained in the paper ultimately produced. Paper for packaging and container uses, for example, must have a high degree of strength and integrity. For this reason softwood, with its characteristically long and inherently strong fibers, is chemically pulped to yield a furnish having the properties needed in papers of this type.

Paper used as newsprint or in other printing applications need not have the same degree of strength as packaging and container papers. Consequently, the mechanical pulping processes used to make furnishes for newsprint and like papers, including groundwood, thermomechanical (TMP) and chemical thermomechanical (CTMP) pulp processes, are designed to give higher yields of fibers of shorter average lengths, and more fines, than are obtained using typical chemical pulping processes. And while papermaking fibers obtained by mechanical pulping have certain properties that are in general undesirable —low brightness, color reversion with time and high resin contents — this is usually tolerated because of the cost savings achievable using these high yield pulping processes.

Pulps or furnishes used in continuous processes for making paper generally consist of fibers, fines, fillers and chemicals suspended or dissolved in water. It is desirable to retain the fines in the paper produced, not only for purposes of pollution control but also to insure the greatest possible utilization of the wood being pulped and the other substances added and hence increase profitability. Such fines suspensions may contain pitch colloids not retained initially in the fiber mat, cellulose fines and hemicellulose, recirculated talc, kaolin or other fillers and pigments, and water soluble materials such as alum.

Fines create a number of manufacturing problems, chiefly due to the difficulty of separating water used to make paper from the papermaking fibers while retaining fines with the fibers. Fines not retained with the fibers recirculate with the process water, and increasingly large concentrations of fines in the process water adversely affect drainage and paper formation. Reduced drainage can slow papermaking speed and increase the cost of making the paper. Poor paper formation reduces the quality of the manufactured sheet, causes production losses, or both, and thus can also increase manufacturing cost. The inability to incorporate fines in the paper and consequently the waste of this material, and particularly the paper fines portion of the pulp product, will further increase costs.

Fines retention does not necessarily mean retention of all the fines present. Prior art processes typically used to make the more expensive fine papers focus on the retention of fillers and pigments in the paper while maintaining wet strength and adequate filler loading. Newsprint is relatively inexpensive in comparison to finer grades of paper. Additives such as fillers and retention aids are not normally used in newsprint, since to do so would greatly increase its cost.

As indicated above, papermaking pulps are usually made in one of three ways: by chemical, semichemical, or mechanical pulping processes. In preparing chemical pulps, e.g., by the Kraft or sulfate and sulfite processes, cellulose fibers constituting the pulp are separated from other wood components by chemical reagents. Kraft and bleached pulps contain minor amounts of pitch, present as saponified pitch or pitch soap. Semichemical processes, usually used on deciduous wood species, involve a mild chemical action followed by mechanical attrition. Mechanical pulps are prepared by grinding whole logs, without prior debarking, and thus the pulp obtained contains all of the constituents of the log, including pitch.

Mechanical pulps such as groundwood and thermomechanical pulps commonly used in newsprint mills, sulfite mills and like operations are typically prepared from nondeciduous wood species such as Sitka Spruce, Norway Pine and the like. The large amounts of pitch found in mechanical pulps cause severe pitch problems in papermaking facilities using them, and yet despite extensive studies no completely satisfactory method for pitch control in processes used to make newsprint has been developed prior to this invention. Groundwood pulp contains large amounts of completely non-saponified pitch in the form of colloidal dispersions whose particles generally range in size from about 0.2 to about 2 $\mu$m and normally have an electronegativity of from about $-10$ to about $-35$ mV. Thermomechanical pulps contain the same types of pitch found in groundwood pulps but generally in greater amounts.

Resins carried over from wood or bark pulped to make papermaking furnishes are complex mixtures of organic compounds which, because they are insoluble in water, will deposit on the fibers in the furnish and on the papermaking equipment. Aggregations of these resinous materials of larger than colloidal dimensions will interfere with the manufacture of high quality paper. Such resinous materials will, for simplicity's sake, be referred to collectively hereinafter as pitch or pitch colloids.

Pitch colloids found in pulp generally are oleophilic, water insoluble, low molecular weight, relatively nonpolar coagulable resins which are usually made up of at least several of the following components: fatty acids and resin acids having ionizable hydrophilic groups, esters of these acids, sterols, diglycerides, triglycerides, terpenes, waxes and various alcohols, hydrocarbons, and neutral compounds associated with these resins. The degree of fluidity of these resins is governed by the ratio of fatty acids to resin acids, the age of the wood, and the degree of oxidation or polymerization of the pitch. These factors determine the resins' deposition tendencies. In aqueous wood pulp slurries such resins are present on the surfaces of the fibers in the form of thin patches and droplets, inside parenchyma cells, as soluble soaps, and in the form of colloidal droplets dispersed in the process liquid among the fibers.

These resin or pitch particles agglomerate to give sticky films or pitch balls, which in turn can give rise to spotting in the final paper product, wire spots, localized sticky spots on rolls, holes in the paper sheet, poor paper formation, felt plugging or sticking on dryer and calender rolls.

To control pitch effectively it is not necessary to remove all of the pitch from the pulp. Different types of pulp mills and paper mills have different tolerance levels for pitch particles which must be exceeded before pitch-caused problems occur. What is necessary, however, is that the pitch be dispersed as tiny, non-harmful aggregated or agglomerated particles and retained in this fine particulate form rather than as larger, harmful globs in the paper sheet. Simply flocculating pitch will not give good pitch control; the pitch must be made to attach to either the cellulosic fibers or to any particulate matter used as a filler in the paper sheet, or preferably to both. Pitch retained in large flocs causes breaks and undesirable dark specks in the finished paper sheet, while pitch not retained but in small flocs tends to accumulate in the papermaking facility's white water system.

Effective pitch control, particularly in paper mills which produce paper from mechanical pulps, e.g., groundwood pulp mills which produce newsprint, has proven to be complex and difficult to accomplish even when attempted. Typically, attempts to control pitch during papermaking involve either physically removing pitch particles from the papermaking system or in some fashion decreasing their deposition on the papermaking equipment, e.g., by attempting to finely disperse the pitch and remove it in the paper, a procedure which up to now has not been entirely successful.

Pitch particles have been physically removed from papermaking systems by methods such as pulp fractionation, which involves removing a substantial portion of the colloidal pitch present together with a portion of the pulp fines. Such methods are prohibitively expensive, since they significantly increase the amount of pulp needed to make a given quantity of paper and pulp fines removed in the process are lost.

Attempts to decrease pitch deposition by dispersing or precipating the pitch have typically involved the use of alum, talc, chemical dispersing agents, retention aids, or mixtures of such materials. The idea behind using such substances is to prevent or reverse pitch agglomeration and the formation of larger pitch particles which can collect on papermill machinery and also appear as dirt specks or globs in the paper.

Canadian Patents Nos. 454,036, issued Jan. 11, 1949 to Carpenter et al and 565,955, issued Nov. 11, 1958 to Craig et al, teach the use of alum and sodium aluminate, respectively, for this purpose. While both of these substances can provide noticeable reductions in the amount of pitch present during papermaking, neither by itself will overcome the pitch problem entirely.

Typically, alum-based pitch controlled systems in which alum is used alone or together with a base such as sodium hydroxide attempt to control pitch deposition by first dispersing the pitch, if it is not already sufficiently dispersed, and then flocculating it. Microscopic examination of this floc shows very little of the pitch actually attached to the papermaking fibers. Instead, the pitch is largely attached to itself as agglomerates consisting of many pitch particles clustered together. These clusters are small enough to pass through the wire of a newsprint mill and get into the whitewater system, resulting in pitch buildup. Additionally, alum is extremely corrosive, necessitating rigorous pH control, in high concentration causes drainage and retention aid losses, and in some papers may also contribute to a loss of brightness, or yellowing, with age accompanied by loss of strength.

Talc per se, such as Mistron Vapor talc produced by Cyprus Industrial Minerals Company, has been used to control pitch in pulp and paper mills, usually Kraft or sulfite mills operating at a high enough pH to cause any pitch present to be partially saponified. The dispersed pitch particles are adsorbed on the faces of the talc particles and then retained in the paper. Attempts have been made to increase pitch adsorption by increasing the talc's surface area. However, too finely ground talc loses crystallinity and all ability to adsorb pitch; talc's pitch adsorption efficiency appears to peak at a surface area of about 15 square meters per gram.

U.S. Pat. No. 4,305,781, issued Dec. 15, 1981 to Langley et al and related Canadian Patent No. 1,168,404, issued June 5, 1984, teach the use of bentonite clay as a filler, together with a water soluble, high molecular weight, substantially nonionic polymer, such as a polyacrylamide, a poly(dialkylaminoalkylacrylate) or polyethylene oxides (PEO), in papermaking, and state that this system results in a reduction in solvent extractable resinous pitch content in the mill's white water system.

European pulp and paper mills are known to use a dual filler retention system in which a naturally occurring cationic bentonite is introduced into the headbox after the last point of high shear, followed by the addition of a high molecular weight anionic polymeric flocculant. Bentonite mined from specific deposits has been demonstrated to exhibit a moderate degree of pitch control in addition to filler retention properties. Attempts to replace these specific bentonites with bentonites from other deposits, however, or with mica or talc, have proven unsuccessful from both a pitch control and a filler retention standpoint.

Modified bentonite clays have also been used as cationic scavengers in mill process water to neutralize fiber fines and other anionic trash.

Chemical dispersants, generally anionic or nonionic in nature, have been used to maintain pitch colloids in a dispersed state in papermaking systems — in the pulp, stock, furnish and whitewater — to prevent pitch deposition within the system. These dispersants function by charge or steric repulsion phenomena. Anionic dispersants, for example, impart a still higher electronegative charge to pitch colloid particles, keeping them from touching and flocculating. Some dispersants may also tend to soften and dissolve those pitch deposits already formed. However, since chemical dispersants do not attach the pitch to the papermaking fibers, they have proven to be inadequate in solving severe pitch problems, such as those found in groundwood pulp (newsprint) mills. Their use in fact can result in a buildup of pitch in the mill's tightly closed recirculated water system.

Retention aids, usually polymeric in nature, have been used to control pitch to a certain extent by flocculating the dispersed pitch resins. In pulps containing large amounts of pitch, however, such as groundwood pulps, the relatively large quantities of dissolved and dispersed polymer-attracted materials present ("anionic trash" or "pernicious objectionables") consume large quantities of the added retention aid, thus rendering them ineffective. To obtain good flocculation it becomes necessary to add still larger amounts of retention aid, which is at best marginally cost effective. Furthermore, the addition of too much retention aid results in overflocculation, adversely affecting the formation of acceptable paper.

A number of prior art patents and literature articles disclose the use of cationic, anionic and nonionic polymers, as well as mixtures of two or more of such polymers, as retention aids which, in addition to performing their primary function, may also control pitch to some extent.

U.S. Pat. No. 3,141,815, issued to Manely on July 21, 1964 discloses that high molecular weight nonionic PEO can increase fines retention during papermaking in certain mechanical pulps, while U.S. Pat. No. 4,070,236, issued Jan. 24, 1978 to Carrard et al, teaches that mixtures of PEO with certain synthetic phenolic compounds perform the same function.

Pelton et al, "A Survey of Potential Retention Aids for Newsprint Manufacture," *Paprican*, July 1978, notes that retention aids may reduce pitch problems in newsprint mills by flocculating colloidal pitch onto fibers and fines and subsequently incorporating these pitch-coated particles into the paper sheet. Pelton et al observed a decrease in the concentration of colloidal pitch when 1 lb/ton of PEO was added to the headbox stock. PEO retention aids are, however, of limited applicability, since they are sensitive to shear and thus can be used only at locations in the papermaking process at which relatively low hydrodynamic shear forces are found. PEO is also very sensitive to depolymerization by trace amounts of chlorine and hence cannot be used with chlorine bleached pulps.

U.S. Pat. No. 4,313,790, issued Feb. 2, 1982 to Allen et al, discloses adding a Kraft lignin or modified Kraft lignin and polyethylene oxide to a mechanical pulp papermaking furnish to increase fines retention and decrease pitch deposition. At column 7, lines 42–56, of the Allen et al patent, the addition of the Kraft lignin derivative and/or polyethylene oxide is said to decrease the concentration of colloidally dispersed wood resin particles in the white water from $88\times10^6$ to as low as $5\times10^6$ particles per $cm^3$.

Very high molecular weight organic polymers such as PEO used as filler retention aids have not proven effective for flocculating bleached, groundwood or thermomechanical pulp. See, for example, Leung et al, "Flocculation of Paper Fines by Polyethyleneoxide," *Tappi Journal*, Vol. 70, No. 7, pages 115–118, July 1987; C.H. Tay, "Application of Polymeric Flocculant in Newsprint Stock Systems for Fines Retention Improvement," *Tappi Journal*, Vol. 63, No. 6, pages 63–66, June 1980; Pelton et al, "Novel Dual-Polymer Retention Aids for Newsprint and Groundwood Specialties," *Tappi Journal*, Vol. 64, No. 11, November 1981.

U.S. Pat. No. 2,795,545, issued June 11, 1957 to Gluesenkamp, discloses adducts prepared by reacting:

> ". . .inorganic solids that are gel-forming in water and/or that possess ion exchange like properties, e.g., clays [including kaolinite and montmorillonite], . . ."

with:

> ". . .cationic polymers. . .[such as homopolymers and copolymers of vinylpyridines, amino alkyl acrylates, amino alkyl methacrylates, and quaternized derivatives thereof, and poly-N-allyl amines]. . ."

to form "polycations"; see, e.g., column 3, lines 44–61; column 4, lines 9–38; column 5, lines 49–66, column 6, lines 12–39 and column 8, line 32-column 9, line 4. Such "polycations" can then be used:

> ". . .to improve the clay retention in paper making wherein clay is used as a beater additive";

see, e.g., column 2, lines 44–46 and column 12, lines 30–64.

Polymers or polymer/filler conglomerates for use as filler or pigment retention aids have also been disclosed in the following patents: acrylamide polymers, U.S. Pat. No. 3,052,595; cationic starch-g-poly(N,N'-methylenebisacrylamide-coamine) copolymers, U.S. Pat. No. 4,278,573; cationic starches, U.S. Pat. No. 4,643,804; cationic latexes, U.S. Pat. No. 4,445,970; conglomerates of a high molecular weight substantially anionic or cationic polyacrylamide (molecular weight at least 2,000,000) and a filler such as china clay, talc or titanium dioxide, such conglomerates having a zeta potential between −40 and +40 electron volts ($-6.4\times10^{-8}$ volt to $+6.4\times10^{-8}$ volt), U.S. Pat. No. 4,181,567; and dual polymer systems such as that disclosed in Japanese Laid-Open Patent Application No. 55-163298 to Mitsubishi Paper Mills, Ltd. published Dec. 19, 1980, in which a water soluble or dispersible cationic polymer is first added to a filler and this mixture is then added to a wood pulp slurry containing an anionic polymer, and those disclosed by Britt et al in "Electrophoresis in Paper Stock Suspensions as Measured by Mass Transport Analysis," *Tappi* Journal, Vol. 57, No. 12, pages 81–84, December 1974, and in "New Methods for Monitoring Retention," *Tappi Journal*, Vol. 59, No. 2, pages 6770, February 1976, which teaches adsorbing a low-molecular weight cationic polymer, polyethylene imine, onto the solid surfaces of the pulp stock followed by the addition of a long-chain anionic polymer to this suspension, forming a floc that is said to be very resistant to redispersion. None of these patents, patent applications and literature articles, however, disclose control, or even reduction, of pitch when using their polymer or polymer/filler conglomerate retention aids.

In summary, it is evident from the prior art that various polyelectrolytes, by themselves or as polymer/filler conglomerates, have been used for fines retention in making fine papers, and that polyelectrolytes themselves, but not polymer/filler conglomerates, are known to reduce pitch in certain pulps and papermaking furnishes. However, when polyelectrolytes were used in wood furnishes containing more than 10% mechanical pulp they were found to be ineffective both in improving fines retention and in reducing pitch and pitch-related problems. A recent article, *Tappi Journal*, Vol. 70, No. 10, beginning at page 79 (1987), reviews this situation.

It is generally agreed that polyelectrolytes per se are ineffective in improving fines retention and reducing pitch in wood furnishes containing mechanical pulp for a reason adverted to above, the presence in such furnishes of relatively large quantities of "anionic trash" or "pernicious objectionables". These polymer-consuming substances are not present or present only in inconsequential amounts in pulps prepared by techniques other than mechanical pulping, for example chemical or semi-chemical methods, because such other pulps are washed to a far greater extent than mechanical pulps.

SUMMARY OF THE INVENTION

It has now been discovered, quite unexpectedly in view of the knowledge and experience of the prior art, that particulate composite substances made by adsorbing a water soluble cationic polymer, e.g., a poly(dialkyldiallylammonium halide) or the like, onto an essentially water insoluble particulate substrate, e.g., a phyllosilicate mineral and particularly kaolin, said polymer being sufficiently electropositive so that the resulting particulate composite pitch control substance exhibits a strong electropositive surface charge, or in other words a high positive zeta potential, of at least about +30 mV (about +0.03 volt; electrophoritic mobility $=\mu ms^{-1} V^{-1} cm$), and preferably from about +60 to about +80 mV, provide an effective means of reducing pitch during all types of pulping and papermaking processes: ones using bleached or unbleached pulp, Kraft pulp, sulfite pulp, and similar processes for making "fine" or "high strength" papers, but particularly, and for the first time in a commercially successful manner, in pulping and papermaking processes using mechanical (groundwood, thermomechanical and newsprint) furnishes.

Other desirable effects, including improved fines retention, better drainage and lower waste treatment costs are also obtained when practicing this invention.

It has also been discovered that the aforementioned particulate composite pitch control substances, used together with a relatively high molecular weight alkylene oxide polymer, such as a polyethylene oxide having a molecular weight, as determined by intrinsic viscosity measurements, of at least about 500,000 and up to about 12,000,000, can provide further improvements in pitch control and fines retention in all types of pulping and papermaking processes, but once again particularly in ones using mechanical furnishes.

It has been further discovered that pitch control systems comprising alum and the aforementioned particulate composite pitch control substances, with or without a relatively high molecular weight alkylene oxide polymer, can provide still further improvements in pitch control and fines retention in all types of pulping and papermaking processes, and once again particularly in ones using mechanical furnishes.

It is therefore an object of this invention to control pitch in pulp and papermaking facilities.

A further object of this invention is to provide a novel pitch control method which also improves fines retention and drainage and lowers waste treatment costs in all types of pulping and papermaking processes.

A still further object of this invention is to provide novel combinations including particulate composite pitch control substances for use in practicing this invention.

Another object of this invention is to provide pitch control, fines retention-improving and drainage-improving compositions comprising such combinations including particulate composite pitch control substances and a relatively high molecular weight alkylene oxide polymer.

Yet another object of this invention is to provide pitch control, fines retention-improving and drainage-improving compositions comprising alum and the aforementioned particulate composite pitch control substances, with or without a relatively high molecular weight alkylene oxide polymer. These and other objects, as well as the nature, scope and utilization of this invention, will become readily apparent to those skilled in the art from the following description and appended claims.

DETAILED DESCRIPTION OF THE INVENTION

Figure 1:
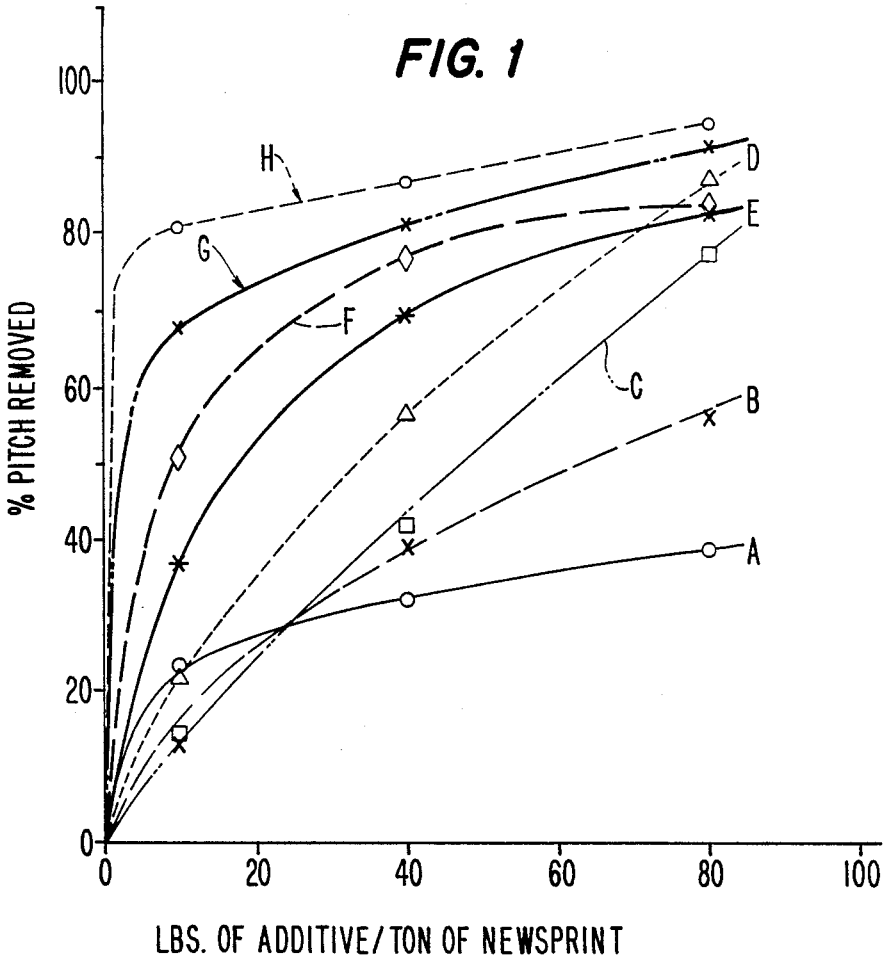
FIG. 1 is a graphic representation comparing the amounts of pitch removed from a newsprint furnish by talc alone (Sample A), a cationic talc pitch control substance prepared in accordance with this invention (Sample B) and cationic kaolin, cationic kaolin/alum, cationic kaolin/PEO and cationic kaolin/alum/PEO pitch control substances also prepared in accordance with this invention (Samples C–H, inclusive).

In practicing this invention the water soluble cationic polymer is first dissolved in water and contacted with the essentially water insoluble particulate substrate. This results in the polymer being irreversibly adsorbed onto the surface of the substrate, thereby rendering the polymer insoluble and immobile. While we do not wish to be bound by any theory or mechanism advanced to explain the operation of this invention, it appears that the strongly electropositive surface of the thus-obtained stable, water dispersible, three dimensional particulate composite pitch control substance, which results from the adsorbed polymer's cationic charge, attracts negatively charged pitch or pitch colloid and adsorbs it onto the particulate composite's surface. The resulting discrete pitch-containing particulate aggregate formed in the furnish, whether because of electropositive surface charge remaining after adsorption of pitch or pitch colloid onto the particulate composite's surface, the size or dimensions of the aggregate formed, or some other factor, will be retained in finely dispersed form within the paper sheet ultimately produced.

Surprisingly, the particulate composite substances of this invention have been found to be many times more efficient in controlling pitch than the cationic polymer components thereof used by themselves; see Example XI hereinbelow.

Although any essentially water-insoluble particulate organic or inorganic substance can be employed as the substrate, phyllosilicate minerals: kaolin, talc, mica, montmorillonite, chlorite, pseudolayer silicates, etc.; see U.S. Pat. Nos. 4,391,733 and 4,391,734, issued July 5, 1983 to Lamar et al and Ferreira et al, respectively, and especially kaolin, are particularly preferred as the essentially water-insoluble particulate substrate onto which a cationic polymer is adsorbed to produce the particulate composite pitch control substances of this invention. Kaolin is a naturally hydrophilic clay mineral consisting essentially of hydrous aluminum silicates in the form of alternating silicon-oxide and aluminum-hydroxyl layers or sheets having an approximate composition of $Al_2O_3.2H_2O$. In its natural state kaolin has a strong negative zeta potential and little or no tendency to adsorb pitch.

Other essentially water-insoluble particulate inorganic substrates which can be used in practicing this invention include materials such as titanium dioxide, aluminum hydrate, hydrated silica, serpentine, calcite (calcium carbonate), and the like. Essentially water-insoluble particles suitable for use as substrates in practicing this invention can range in particle size from fine, about 0.1 μm, to coarse, about 40 μm.

As indicated above such essentially water-insoluble particles are made cationic for use in practicing this invention by adsorbing on the particles' surfaces a cationic polymer. Suitable cationic polymers will be ones which exhibit the ability to change the zeta potential of the particulate substrate, whether negative or somewhat positive, to a zeta potential sufficiently positive to provide effective pitch control in accordance with the teachings of this invention. For example, kaolin in its natural state has a zeta potential of about −40 mV. The addition of a sufficient quantity of poly(diallyldimethylammonium chloride) or a similar strongly cationic polymer to kaolin can result in the thus-obtained polymer/kaolin composite's exhibiting zeta potentials of up to about +80 mV or higher.

Useful cationic polymers for this purpose include, but are not limited to, salts, such as quaternary ammonium salts and acid salts, of aminoacrylates and salts, such as quaternary ammonium salts and acid salts, of diallylamines which may contain substituents such as carboxylate, cyano, ether, amino (primary, secondary or tertiary), amide, hydrazide and hydroxyl groups, and the like, whose zeta potentials are sufficiently positive to provide particulate composite substances having zeta potentials of at least about +30 mV, and preferably from about +60 to about 80 mV (about +0.06 volt to about +0.08 volt) or above. Among such cationic polymers are poly(alkyltrimethylammonium chlorides), poly(alkyltrimethylammonium bromides), poly(dialkyldiallylammonium halides) such as poly(diallyldimethylammonium chloride) and poly(diallyldimethylammonium bromide), poly(methacryloyloxyethyltrimethylammonium methyl sulfate), poly(methacryloyloxyethyltrimethylammonium chloride), poly(methacryloyloxyethyldimethylammonium chloride), poly (methacryloyloxyethyldimethylammonium acetate), poly(methyldiallylammonium acetate), poly(diallylammonium chloride), poly(N-methyldiallylammonium bromide), poly(2,2'-dimethyl-N-methyldiallylammonium chloride), poly(N-ethyldiallylammonium bromide), poly(N-isopropyldiallylammonium chloride), poly(N-n-butyldiallylammonium bromide), poly(N-tert-butyldiallylammonium chloride), poly(N-n-hexyldiallylammonium chloride), poly(N-octadecyldiallylammonium chloride), poly(N-acetamidodiallylammonium chloride), poly(N-cyanomethyl-diallylammonium chloride), poly(N-propionamidodiallylammonium bromide), poly(N-acetylethyl ester substituted diallylammonium chloride), poly(N-ethylmethylether substituted diallylammonium bromide), poly(N-ethylaminediallylammonium chloride), poly(N-hydroxy-ethyldiallylammonium bromide), poly(N-aceto-hydrazide substituted diallylammonium chloride), poly(vinylbenzyl-trimethylammonium chloride), poly(vinylbenzyltrimethylammonium bromide), poly(2-vinylpyridinium chloride), poly(2-vinylpyridinium bromide), poly(methacrylamidopropyldimethylammonium chloride), poly(3-methacryloyloxy-2-hydroxypropyldimethylammonium chloride), and the like.

Another class of cationic polymers useful in practicing this invention includes naturally occurring polymers such as casein, chitosan and derivatives thereof.

A particularly preferred cationic polymer is poly(diallyldimethylammonium chloride), which contains the repeating unit:

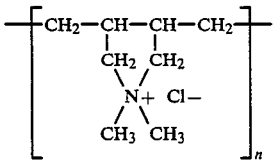

wherein n is from about 600 to about 3500, i.e., poly(diallyldimethylammonium chloride) polymers having an average molecular weight, as determined by intrinsic viscosity measurements, of from about 100,000 to about 500,000.

The addition of the cationic polymer to the substrate particles will generally be carried out at room temperature (about 25° C.), although addition can be carried out at any suitable temperature which will facilitate adsorption of the polymer onto the substrate particles' surfaces. Moderate stirring, e.g., at from about 100 to about 1000 rpm, will also facilitate adsorption.

The amount of cationic polymer added will be, first of all, that amount sufficient to provide particulate composite pitch control substances having a zeta potential of at least about +30 mV, and preferably a zeta potential of from about +60 to about +80 mV. Typically, the resulting aqueous slurry of cationic particulate composite pitch control substance will have a solids content ranging from about 40% to about 70%, and preferably from about 50% to about 60%.

The particular cationic polymer employed, its molecular weight and charge density, and the average particle size of the essentially water insoluble particulate substrate all play a part in determining the amount of polymer used to provide a particulate composite pitch control substance having a sufficient number of positively charged polymer molecules attached to substrate particles to give a mass having a zeta potential within the above-stated range.

By attaching positively charged polymer to the surfaces of substrate particles the effective molecular weight of the polymer is increased, since the finely divided substrate has an aggregate surface area of sufficient size to adsorb thousands of polymer molecules. These composite pitch control particles are believed to be, in general, of a size approximating that of the average pitch particle with which they combine, and they have substantial dimensions in three orthogonal directions -- height, width and depth. In addition, natural charge repulsion is believed to cause the polymer chains attached to these particles to uncoil from their naturally coiled configuration so as to minimize such repulsion, which would then expose additional polymer sites to bulk solution and thus increase the number of such sites available to react with pitch particles.

This explanation is consistent with experimental observations made regarding these particulate composite pitch control substances. For example, higher molecular weight cationic polymers have been found to be more effective than their lower molecular weight counterparts. In laboratory experiments, a cationic poly(diallyldimethylammonium chloride) of 100,000 molecular weight was found to require a polymer: substantially water insoluble substrate ratio of 5 wt.% to give the same effectiveness in combining with pitch particles as the composite of Example I, infra, in which a counterpart polymer of 400,000 molecular weight is present in a polymer: substrate ratio of 2.5 wt.%.

Once a cationic polymer of a given molecular weight has been chosen, a preferred ratio of polymer to substantially water insoluble particulate substrate can easily be determined experimentally. In general, as the ratio of polymer to substrate is increased there is, at first, a slow but steady increase in the effectiveness of the composite substance in combining with pitch particles. Effectiveness becomes more dramatic as this ratio continues to be increased, until the point is reached where effectivenes levels off, at which point further additions of cationic polymer to the substrate produce no further increases in effectiveness. During recent paper mill trials, a cationic polymer: substrate ratio of 2.5% was found to be effective.

Poly(diallyldimethylammonium chloride) is known to have a low affinity for cellulosic materials; Winter, et al., *J. Colloid and Interface Science*, Vol. III, No. 2, June, 1986, pp. 537–543. Low affinity for cellulosic materials, including papermaking fibers, may be an important reason for the effectiveness of the particulate composite pitch control substances of this invention, since if the polymer employed in such substances had a strong affinity for cellulosic fibers, the composite substance, instead of combining with pitch particles, would instead combine with the overabundance of cellulosic fiber and fines in the furnish.

Slurries of cationic particulate composite pitch control substances useful in practicing this invention can also be prepared by continuously adding an aqueous solution of the cationic polymer, for example poly(diallyldimethylammonium chloride), to a flowing aqueous slurry of the substrate particles and then passing the resultant aqueous cationic slurry through a static mixer, from which the slurry can then be fed to the wet end of a papermaking machine.

The relatively high molecular weight alkylene oxide polymers which can be used in conjunction with the above-described cationic particulate composite pitch control substances in practicing this invention are nonionic high molecular weight polymers with a molecular weight of at least about 500,000, as determined by intrinsic viscosity measurements, and preferably a molecular weight of from about 1,000,000 to about 12,000,000. Representative of such alkylene oxide polymers are ethoxylates, propoxylates and ethoxylate/propoxylates, such as polyethylene glycols (polyoxyethylenes), polypropylene glycols (polyoxypropylenes), polyoxyalkylene ethylene glycol and propylene glycol condensates, tridecyloxypoly(ethyleneoxy)ethanols and polyoxyethylene/polyoxypropylene block copolymers; ethoxylates and propoxylates of straight or branched chain fatty acids or alcohols, and particularly naturally occurring fatty acids or alcohols, including polyethyoxylated fatty acid esters such as polyoxyethylene coconut fatty acid esters, polyethoxylated tall oils and polyethoxylated vegetable oils, polyoxyethylene lauryl ethers, myristyl ethers, cetyl ethers, decyl ethers, stearyl ethers, isostearyl ethers, cetostearyl ethers, oleyl ethers, isohexadecyl ethers and soya sterol ethers, polyethoxylated tallow alcohols, polyethoxylated sorbitol, polyethoxylated lanolin alcohols and polyethoxylated acylated lanolin alcohols; ethoxylates and propoxylates of fatty acid glycerides, such as polyoxyethylene glyceryl stearates, laurates and coconates, polyethoxylated castor oil, polyethoxylated hydrogenated castor oil and complex tallow glyceride polyethoxylates; ethoxylates and propoxylates of sorbitan, sorbital and sorbitol fatty acid esters and fatty alcohol ethers, such as polyoxyethylene sorbital laurates, polyoxyethylene sorbitol stearates, polyoxyethylene sorbital oleates, polyoxyethylene sorbitol monotallate, polyoxyethylene sorbitan oleates, stearates, palmitates, laurates and tallates, and polyoxyethylene sorbital oleyl and stearyl ethers. Ethylene oxide polymers preferred for use in practicing this invention are represented by the formula:

$$-(CH_2CH_2O)-_{n}$$

wherein n' is a number such that those polymers will have an average molecular weight of at least about 500,000 up to about 12,000,000.

The relatively high molecular weight alkylene oxide polymers used in practicing this invention may be supplied as true solutions in water, as solid products or as dispersions in a carrier oil, but in all cases they should be dissolved in water and added as dilute aqueous solutions during the pulping or papermaking process.

When controlling pitch in accordance with this invention the cationic particulate composite pitch control substance or a mixture of such substances will ordinarily be added to papermaking pulp (furnish) in amounts ranging from about 5 to about 200 lbs., and preferably from about 10 to about 80 lbs., by weight, per short ton (2000 lbs.) of dry paper pulp in the furnish. When a relatively high molecular weight alkylene oxide polymer is used together with a cationic particulate composite pitch control substance in practicing this invention, the alkylene oxide polymer will be used in amounts ranging from about 0.05 to about 2, and preferably from about 0.10 to about 0.50, lbs. per short ton, based on the dry weight of paper pulp in the furnish.

When alum (aluminum sulfate or one or more double sulfates of trivalent metals such as aluminum and, e.g., a univalent metal such as potassium or sodium, including potassium aluminum sulfate, ammonium aluminum sulfate, and the like) is used together with a cationic particulate composite pitch control substance, with or without a relatively high molecular weight alkylene oxide polymer, it will be used in amounts ranging from about 10 to about 80 lbs., and preferably from about 35 to about 50 lbs., per short ton of dry paper pulp in the furnish, and can be added as early in the papermaking system as possible, e.g., at the grinders.

When a cationic particulate composite pitch control substance, e.g., cationic kaolin, is used in place of or in addition to customarily-added fillers in the furnish, or even if it is used in furnishes in which no filler is customarily added, it ordinarily will be added before the furnish is applied to the wet end of a papermaking machine, and preferably as early in the papermaking system as possible, e.g., at the grinders.

The relatively high molecular weight alkylene oxide polymer causes the formation of a floc in which pitch particles adsorbed onto the cationic particulate composite pitch control particles and fines are held in the paper sheet in a finely dispersed and innocuous state, preventing their entering into the white water system or beyond. The alkylene oxide polymer solution is ideally added after the last point of high shear prior to sheet formation, typically at or close to the headbox but in any event after the refiners. This avoids excessive shear which can adversely impact the alkylene oxide polymer's retention/drainage properties and also ensures good mixing.

It has been found that when using the pitch control systems of this invention it is not necessary to operate at or even close to the isoelectric point to obtain good pitch control, as one might hitherto have been led to expect from traditional electrokinetic theory, and notwithstanding that the paper furnish contains a predominance of negatively charged particles, e.g., cellulose fibers, pitch colloid, fines and perhaps fillers including various mineral fillers such as clay, titanium dioxide and talc, all of which by reason of their negative charges are mutually repellant when dispersed in water.

The pitch control systems of this invention also demonstrate markedly reduced temperature sensitivity compared to PEO used alone, and in fact cationic kaolin-/alkylene oxide polymer pitch control systems prepared in accordance with this invention have been found to exhibit slightly increased pitch adsorption capabilities with increased temperatures.

In order that those skilled in the art can more fully understand this invention, the following examples are set forth. These examples are given solely for the purpose of illustrating the invention, and should not be considered as expressing limitations unless so set forth in the appended claims. All parts and percentages are by weight, unless otherwise stated.

EXAMPLE I

An aqueous slurry of cationic kaolin was prepared by mixing at room temperature (about 25° C.) with stirring at about 1500rpm for 30 minutes:

| Ingredient | Amount (lbs.) |
|---|---|
| Kaolin ("Supreme Clay", an air-floated filler clay from Cyprus Industrial Minerals Company, Georgia, U.S.A.) | 2000.0 |
| Aqueous solution of poly-(diallyldimethylammonium chloride) ("Agefloc-WT-20 VHV"; C.P.S. Chemical Co.; average molecular weight = 400,000) | 250.0 |
| Water | 1166.7 |

The thus-obtained slurry was stable, non-settling, non-foaming and sufficiently fluid for easy handling and pumping. It had a total solids content of 60%, contained 50 parts of poly(diallyldimethylammonium chloride) per 2000 parts of kaolin, and exhibited the following properties:

| | |
|---|---|
| Brookfield viscosity (No. 2 spindle): | |
| at 1 rpm | 18,200 cps |
| at 100 rpm | 1,262 cps |
| Thixotropic index (determined by dividing viscosity at 1 rpm by viscosity at 100 rpm) | 14.4 |
| Zeta potential (measured using a Laser-Zee Meter) | +71.4 mV |
| pH | 6.51 |

Portions of this slurry were then used in the following pitch control experiments.

EXAMPLE II

A typical newsprint furnish containing:
20% bleached groundwood
20% unbleached groundwood
20% coated broke
40% chemical pulp,
was treated with the cationic kaolin slurry of Example I above in the amounts shown in Table I below. Pitch counts were determined on the filtrates from a series of experiments conducted in a dynamic drainage jar [see Britt, K. W., *Tappi Journal*, 56 (10):46(1973); Britt, K. W. and Unbehend, J. E., *Tappi Journal*, 59 (2) 67–70 (1976)]:

TABLE I

| Sample | Contents | Pitch Counts |
|---|---|---|
| A | Control, (no addition) | $152 \times 10^6$ particles/cm$^3$ |
| B | 10 lbs. cationic kaolin/ton of fiber | $125 \times 10^6$ particles/cm$^3$ |
| C | 20 lbs. cationic kaolin/ton of fiber | $106 \times 10^6$ particles/cm$^3$ |
| D | 30 lbs. cationic kaolin/ton of fiber | $77 \times 10^6$ particles/cm$^3$ |
| E | 40 lbs. cationic kaolin/ton of fiber | $48 \times 10^6$ particles/cm$^3$ |
| F | 50 lbs. cationic kaolin/ton of fiber | $29 \times 10^6$ particles/cm$^3$ |
| G | 60 lbs. cationic kaolin/ton of fiber | $7 \times 10^6$ particles/cm$^3$ |

EXAMPLE III

An alum-free sample of groundwood pulp, pH 6.5, was treated with the cationic kaolin slurry of Example I above in the amounts shown in Table II below. Pitch counts were again determined using the dynamic drainage jar.

TABLE II

| Sample | Contents | Pitch Counts |
|---|---|---|
| A | Control (no additive) | $174 \times 10^6$ particles/cm$^3$ |
| B | 10 lbs cationic kaolin/ton | $158 \times 10^6$ particles/cm$^3$ of fiber |
| C | 20 lbs cationic kaolin/ton | $141 \times 10^6$ particles/cm$^3$ of fiber |
| D | 30 lbs cationic kaolin/ton | $123 \times 10^6$ particles/cm$^3$ of fiber |
| E | 40 lbs cationic kaolin/ton | $106 \times 10^6$ particles/cm$^3$ of fiber |
| F | 60 lbs cationic kaolin/ton | $73 \times 10^6$ particles/cm$^3$ of fiber |
| G | 80 lbs cationic kaolin/ton | $40 \times 10^6$ particles/cm$^3$ of fiber |
| H | 100 lbs cationic kaolin/ton | $17 \times 10^6$ particles/cm$^3$ of fiber |

EXAMPLE IV

The same groundwood pulp used in Example III above was first treated with 35 lbs. of papermakers' alum/ton of fiber and then with the cationic kaolin slurry of Example I above in the amounts shown in Table III below. Pitch counts were again determined using the dynamic drainage jar.

TABLE III

| Sample | Contents | Pitch Counts |
|---|---|---|
| A | Control (35 lbs./ton alum) | $77 \times 10^6$ particles/cm$^3$ |
| B | 5 lbs. cationic kaolin/ton of fiber | $33 \times 10^6$ particles/cm$^3$ |
| C | 10 lbs. cationic kaolin/ton of fiber | $22 \times 10^6$ particles/cm$^3$ |
| D | 20 lbs. cationic kaolin/ton of fiber | $13 \times 10^6$ particles/cm$^3$ |
| E | 40 lbs. cationic kaolin/ton of fiber | $7 \times 10^6$ particles/cm$^3$ |
| F | 60 lbs. cationic kaolin/ton of fiber | $2 \times 10^6$ particles/cm$^3$ |

EXAMPLE V

A sample of thermomechanical pulp was first treated with 35 lbs. of papermakers' alum/ton of fiber and then with the cationic kaolin slurry of Example I above in the amounts shown in Table IV below. Pitch counts were again determined using the dynamic drainage jar.

TABLE IV

| Sample | Contents | Pitch Counts |
|---|---|---|
| A | Control (no treatment) | $134 \times 10^6$ particles/cm$^3$ |
| B | Control with 35 lbs. alum/ton of fiber | $48 \times 10^6$ particles/cm$^3$ |
| C | 35 lbs. alum/ton of fiber plus 10 lbs. cationic kaolin/ton of fiber | $25 \times 10^6$ particles/cm$^3$ |
| D | 35 lbs. alum/ton of fiber plus 20 lbs. cationic kaolin/ton of fiber | $18 \times 10^6$ particles/cm$^3$ |
| E | 35 lbs. alum/ton of fiber plus 40 lbs. cationic kaolin/ton of fiber | $11 \times 10^6$ particles/cm$^3$ |

TABLE IV-continued

| Sample | Contents | Pitch Counts |
|---|---|---|
| F | 35 lbs. alum/ton of fiber plus 60 lbs. cationic kaolin/ton of fiber | $7 \times 10^6$ particles/cm$^3$ |

EXAMPLE VI

Pitch counts were determined, using the dynamic drainage jar, for a sample of newsprint furnish, first as-is at pH 6.5, next adjusted to pH 4.5 with papermakers' alum, and then in the presence of varying levels of the cationic kaolin slurry of Example I above by itself or together with 0.10 lbs./ton of polyethylene oxide (PEO) having a molecular weight of $6.0 \times 10^6$. The results of these runs are given in Table V below.

TABLE V

| Sample | Lbs. Cationic Kaolin per ton of fiber | Lbs. PEO per ton of fiber | Pitch Counts at pH 4.5 | (particles $\times 10^{-6}/cm^3$): at pH 6.5 |
|---|---|---|---|---|
| A | 0 | 0 | 188 | — |
| B | 0 | 0.1 | 165 | — |
| C | 10 | 0.1 | 30 | — |
| D | 50 | 0.1 | 6 | — |
| E | 100 | 0.1 | 4 | — |
| F | 0 | | — | 238 |
| G | 0 | 0.1 | — | 205 |
| H | 10 | 0.1 | — | 122 |
| I | 50 | 0.1 | — | 46 |
| J | 100 | 0.1 | — | 16 |

EXAMPLE VII

Pitch deposition on stainless steel plates was determined by the method described by Fred P. Lodzinski in "An Improved Technique for Estimating Depositable Pitch", *Tappi Journal*, Vol. 63, No. 11, Nov. 1980, pages 163–164 for two series of bleached sulfite pulp samples, the first containing varying amounts of an ultra-fine talc ("Mistron Vapor"; Cyprus Industrial Minerals Company) commonly used for pitch control in the papermaking industry, the second containing varying amounts of the cationic kaolin slurry of Example I above. The amounts of these materials added and the results obtained are given in Table VI below.

TABLE VI

| Sample | Lbs. Mineral Additive per ton of fiber | Mg. of Pitch Deposited "Mistron Vapor" (Talc) | Mg. of Pitch Deposited Cationic Kaolin Slurry |
|---|---|---|---|
| A | Control (no additive) | 160 | 160 |
| B | 2.5 | 260 | 68 |
| C | 5 | 300 | 12 |
| D | 10 | 214 | 10 |
| E | 20 | 57 | 6 |
| F | 40 | 44 | 5 |
| G | 60 | 19 | 0 |
| H | 80 | 11 | 0 |
| I | 100 | 6 | |

EXAMPLE VIII

The procedure of Example VII above was repeated in every detail except for the following. Brass plates were substituted for steel (steel and brass are prominent among the metal surfaces commonly exposed to pitch-containing pulps in pulp and paper mills). No runs were made using "Mistron Vapor" talc. The amounts of the cationic kaolin slurry of Example I above which were used and the amounts of pitch deposited in each run are given in Table VII below.

TABLE VII

| Sample | Lbs of Cationic Kaolin per ton of fiber | Mg of pitch Deposited |
|---|---|---|
| A | Control (no additive) | 96 |
| B | 5 | 69 |
| C | 10 | 21 |
| D | 20 | 8 |
| E | 40 | 2 |
| F | 60 | 0 |

EXAMPLE IX

A sample of groundwood pulp was first treated with 50 lbs. of papermakers' alum/ton of pulp, then with the cationic kaolin slurry of Example I above in the amounts shown in Table VIII below, and then subjected to the dynamic drainage jar procedure of Example II. The light transmittances of the thus-obtained dynamic drainage jar filtrates, measured at 410 μm relative to distilled water at 100% transmittance, are also shown in Table VIII.

TABLE VIII

| Sample | Pulp Treatment | Percent Transmittance |
|---|---|---|
| A | None | 9 |
| B | 50 lbs. of alum/ton of fiber | 44 |
| C | 50 lbs. of alum/ton of plus 20 lbs. cationic kaolin/ton of fiber | 50 |
| D | 50 lbs. of alum/ton of fiber plus 40 lbs. cationic kaolin/ton of fiber | 57 |
| E | 50 lbs. of alum/ton of fiber plus 60 lbs. cationic kaolin/ton of fiber | 63 |
| F | 50 lbs. of alum/ton of fiber plus 80 lbs. cationic kaolin/ton of fiber | 69 |

Turbidity in these dynamic drainage jar filtrates is caused by the presence of pitch colloid, fiber fines and other colloidal anionic trash; increases in percent transmittance correspond to reductions in turbidity. As is evident from the data in Table VIII, the cationic kaolin slurry of Example I is effective in tying up and consequently retaining all such fine particle size material.

EXAMPLE X

The substances listed in Table IX below were used in the amounts indicated and at the indicated pH's (pH 6.5 was the initial pH of the furnish; adjustments to pH 4.5 were made using papermaker's alum) to remove pitch from a newsprint furnish containing 50% thermomechanical pulp, 30% groundwood pulp and 20% bleached Kraft pulp.

Pitch removal efficiency was determined by passing the pulp slurry through a dynamic drainage jar, examining the filtrate microscopically, and counting pitch colloid particles using a hemocytometer.

TABLE IX

| Sample | Contents | Lbs./Ton for 40% Pitch Removal |
|---|---|---|
| A | Mistron Vapor (talc), pH 4.5[1] | 88 |
| B | Cationic talc,[2] pH 4.5 | 42 |
| C | Cationic kaolin,[3] pH 6.5 | 36 |
| D | Cationic kaolin, pH 4.5 | 24 |
| E | Catioic Kaolin + 0.10 lbs./ton PEO,[4] ph 6.5 | 12 |
| F | Cationic kaolin + 0.50 lbs./ton PEO, pH 6.5 | 6 |
| G | Cationic kaolin + 0.10 lbs./ton PEO, pH 4.5 | 2 |
| H | Cationic kaolin + 0.50 lbs./ton PEO, pH 4.5 | 1 |

[1]Prepared as a 40% solids slurry without any dispersant.
[2]Aqueous slurry prepared at 60% solids, containing 60 lbs./ton of Agefloc WT-20.
[3]Aqueous slurry prepared as described in Example 1 above.
[4]Polyethylene oxide, molecular weight $6 \times 10^6$.

The results given in Table IX are depicted graphically in FIG. 1, and demonstrate that:

1. The cationic kaolin slurry of Example I was more effective under these circumstances than either Mistron Vapor talc or a comparably-prepared aqueous cationic talc slurry (Samples A, B, C and D) in controlling pitch in a newsprint furnish.

2. The pitch-controlling effectiveness of the cationic kaolin slurry was further enhanced by the addition of alum (Samples D, G and H) and still further enhanced by the additional of polyethylene oxide (Samples E, F, G and H).

Example XI below demonstrates that simply adding a cationic polymer itself to a pitch-containing paper pulp is not nearly as effective in controlling pitch as first adsorbing the polymer onto the surfaces of kaolin particles and then adding this substance to the pulp.

EXAMPLE XI

In one series of runs, "Agefloc WT-20"[poly(diallydimethylammonium chloride); C.P.S. Chemical Co.; average molecular weight =150,000]was added as 5% aqueous solution to groundwood pulp in the amounts shown in FIG. 2. No kaolin was present.

Figure 3:
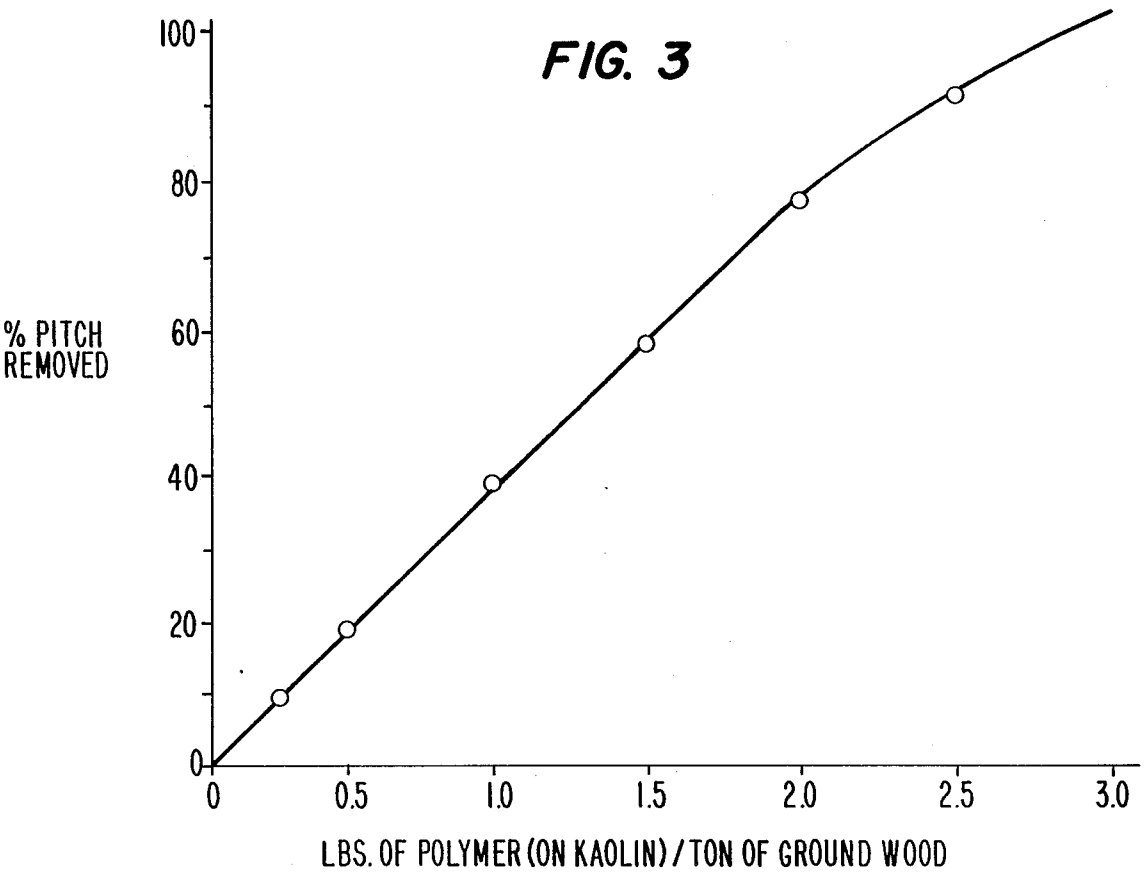

In a second series of runs, an aqueous 60% total solids slurry of cationic "Supreme Clay" kaolin, made by adsorbing onto the kaolin 50 lbs. of "Agefloc WT-20" poly(diallyldimethylammonium chloride) solids per 2000 lbs. of kaolin, on a solids basis, was added to the same groundwood pulp used in the first series of runs in the amounts shown in FIG. 3 (i.e., 0.5 lbs. of polymer per 20 lbs. of cationic kaolin, 2.5 lbs. of polymer per 100 lbs. of kaolin, etc).

In each of these series of runs, pitch removal was determined by the dynamic drainage jar method.

Figure 2:
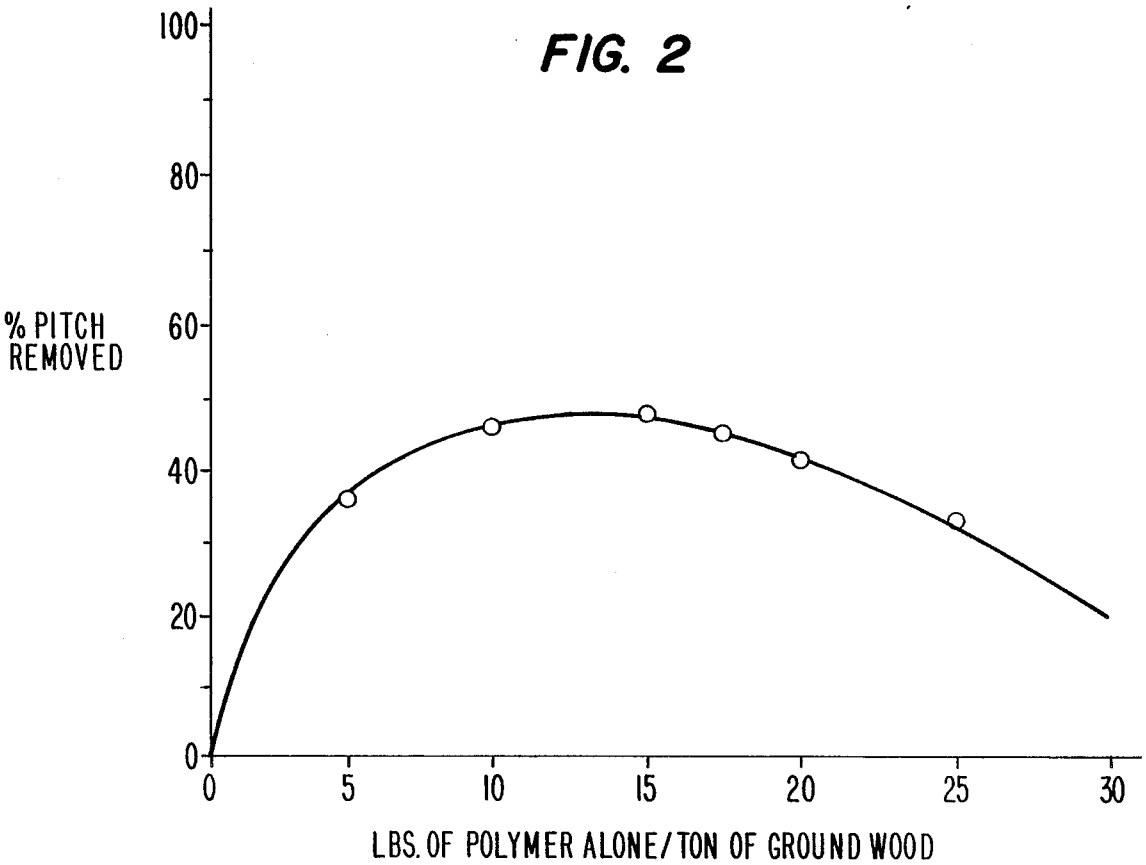
FIGS. 2 and 3 are graphic representations comparing pitch reduction in a groundwood pulp accomplished by the addition of a cationic polymer itself without kaolin (FIG. 2) and by the same polymer added as a pre-adsorbed particulate composite on kaolin (FIG. 3).

As can be seen from FIG. 2, the polymer added by itself does reduce pitch with the amount of reduction peaking at 47% at the level of 12.5 lbs. of polymer added, on a solids basis, per ton of pulp. In fact, additions in excess of this level proved to have a deleterious effect.

FIG. 3 shows that only 1.22 lbs. of the polymer will remove 47% of the pitch present when the polymer is first adsorbed on kaolin. Then, dividing the amount of polymer added by itself required to remove 47% of the pitch present by the amount required to accomplish the same reduction in pitch when the polymer is adsorbed on kaolin ($12.5 \div 1.22$) shows that the kaolin-adsorbed polymer was 10.2 times more effective than the unadsorbed polymer for this purpose.

FIG. 3 also shows that levels of pitch removal approaching 100% are achievable simply by adding more kaolin-adsorbed polymer.

EXAMPLE XII

Figure 4:
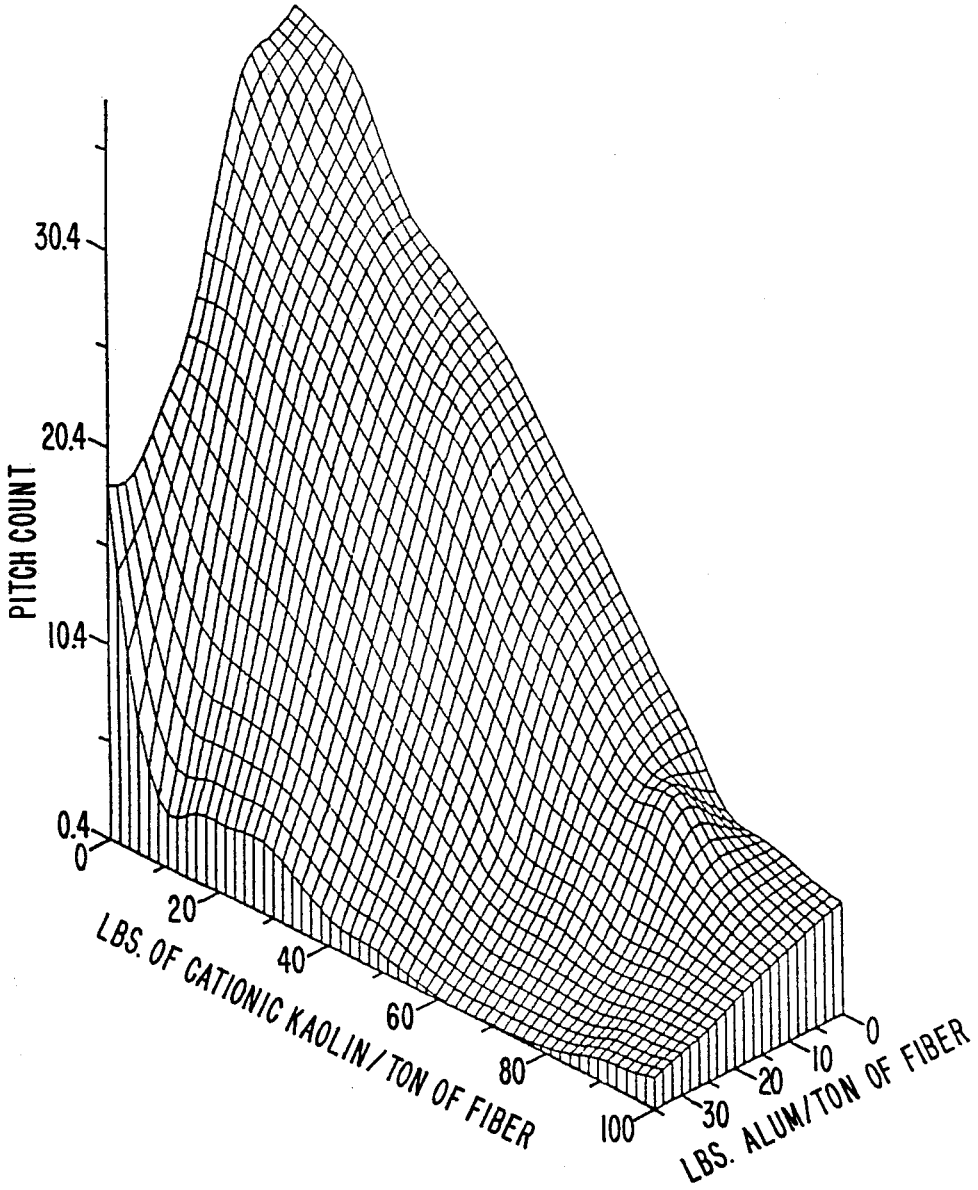
FIGS. 4 and 5 are computer-generated graphic representations illustrating the effect on pitch content in a groundwood pulp achieved by adding a cationic polymer as a pre-adsorbed particulate composite on kaolin, adding the same composite plus alum, and adding alum alone.

With reference first to computer-generated FIG. 4, the effect on pitch content obtained by adding to pitch-containing groundwood pulp:

the cationic kaolin slurry of Example I above without any alum being present (the back side of FIG. 4);
alum alone (the other far side of FIG. 4, to the left);
various combinations of cationic kaolin slurry and alum (the remainder of the curved response surface within the rectangular base of FIG. 4);

was determined. The amounts of cationic kaolin slurry used ranged from 0 to 100 lbs./ton of dry fiber in the pulp; the amounts of alum used ranged from 0 to 35 lbs./ton of dry fiber in the pulp. Pitch counts were again determined using the dynamic drainage jar.

The low point in pitch count was achieved using 60–80 lbs./ ton of cationic kaolin slurry with 35 lbs./ton of alum, and in fact as shown in FIG. 4 these combined amounts of cationic kaolin slurry and alum essentially eliminate all pitch.

Figure 5:
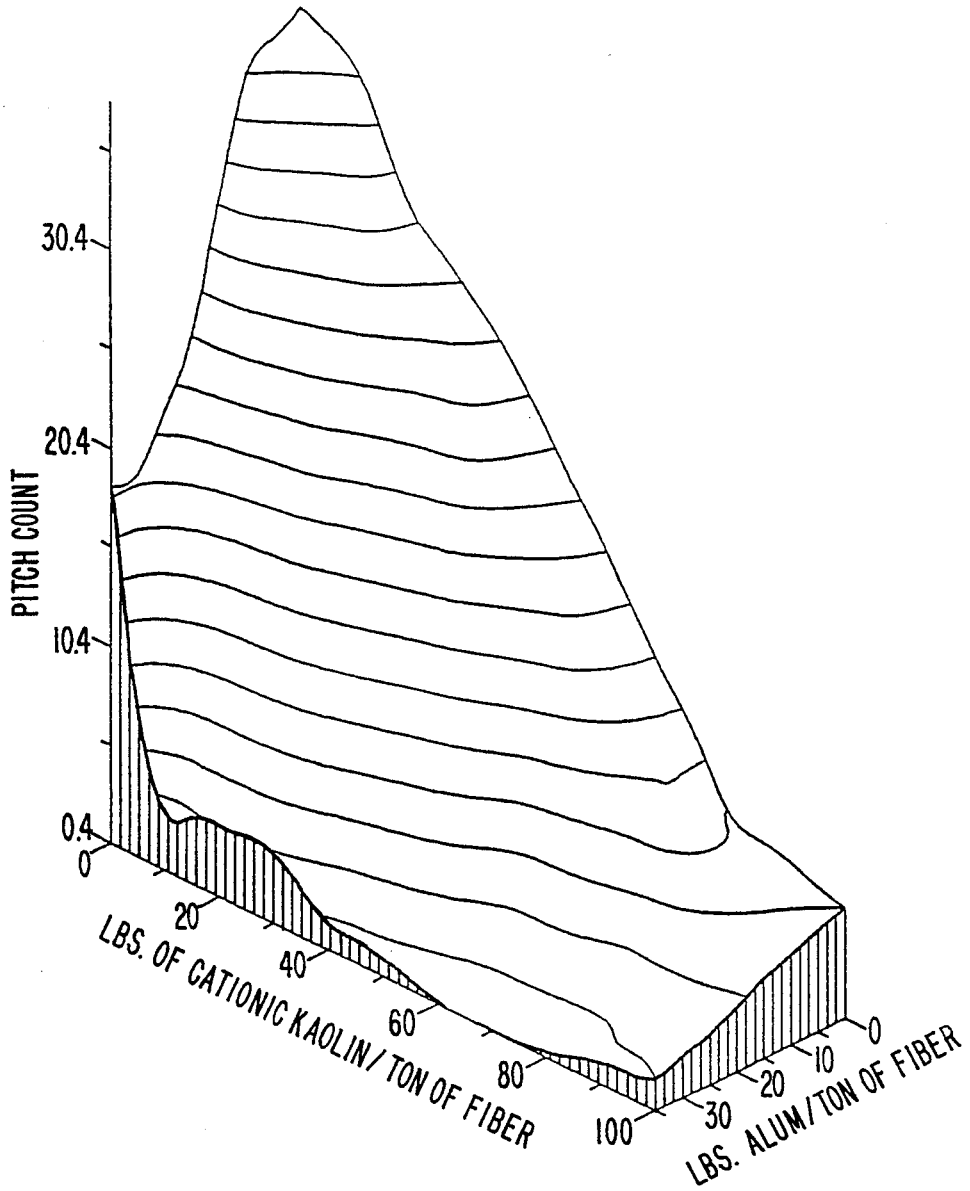

Next, the same experimental data used to generate FIG. 4 were used to provide computer-generated FIG. 5, which illustrates still another type of response surface having contours of equal pitch content (isopitches). As can be seen from FIG. 5 various combinations of cationic kaolin and alum can be used to give the same level of pitch control, and thus economics can be one factor considered when effecting a particular level of pitch control by practicing this invention. For example, the second contour line from the bottom of FIG. 5 shows that this level of pitch control (a pitch count of approximately 3.0) can be obtained using either 100 lbs./ton of cationic kaolin slurry plus 16 lbs./ton of alum or 7 lbs./ton of cationic kaolin slurry plus 35 lbs./ton of alum. Similarly, the third contour line from the bottom of FIG. 5 shows that this level of pitch control (a pitch count of approximately 5.0) can be obtained using either 100 lbs./ton of cationic kaolin slurry and no alum or 5 lbs./ton of cationic kaolin slurry plus 35 lbs./ton of alum. This gives the papermaker great latitude in his selection of a pitch control system embodying this invention as well as in the alum (or pH) level at which he chooses to operate.

The above discussion of this invention is directed primarily to preferred embodiments and practices thereof. It will be readily apparent to those skilled in the art that further changes and modifications in the actual implementation of the concepts described herein can easily be made without departing from the spirit and scope of the invention as defined by the following claims.

We claim:

1. A method of reducing pitch in pulping and papermaking operations which comprises:

(1) adding to a pitch-containing furnish a particulate composite substance comprising (a) a water soluble cationic polymer adsorbed onto (b) an essentially water insoluble particulate substrate, said polymer being sufficiently electropositive so that said composite substance exhibits a zeta potential of at least about +30 mV, and (2) adsorbing pitch onto said composite substance to form discrete, finely dispersed pitch-containing aggregates in said furnish.

2. A method as recited in claim 1 in which said water soluble cationic polymer is sufficiently electropositive so that said composite substance exhibits a zeta potential of from about +60 to about +80 mV.

3. A method as recited in claim 1 in which said water soluble cationic polymer is a poly(dialkyldiallylammonium halide).

4. A method as recited in claim 1 in which said water insoluble particulate substrate is a phyllosilicate mineral.

5. A method as recited in claim 2 in which said water soluble cationic polymer is a poly(diallyldimethylammonium chloride) having an average molecular weight of from about 100,000 to about 500,000 and said water insoluble particulate substrate is kaolin.

6. A method as recited in claim 5 in which said kaolin has a particle size ranging from about 0.1 μm to about 40 μm.

7. A method as recited in claim 6 in which said composite substance is added to said furnish in an amount ranging from about 5 to about 200 lbs. per short ton of dry pulp in said furnish.

8. A method as recited in any one of claims 1–7, inclusive, in which a nonionic alkylene oxide polymer having a molecular weight of at least about 500,000 is also added to said pitch-containing furnish.

9. A method as recited in claim 8 in which said alkylene oxide polymer is a polyethylene oxide.

10. A method as recited in claim 9 in which the polyethylene oxide is added in an amount ranging from about 0.05 to about 2 lbs. per short ton of dry pulp in said furnish.

11. A method as recited in any one of claims 1–7, inclusive, in which alum is also added to said pitch-containing furnish.

12. A method as recited in claim 11 in which alum is added in an amount ranging from about 10 to about 80 lbs. per short ton of dry pulp in said furnish.

13. A method as recited in any one of claims 1–7, inclusive, in which a nonionic alkylene oxide polymer having a molecular weight of at least about 500,000 and alum are also added to said pitch-containing furnish.

14. A method as recited in claim 13 in which said alkylene oxide polymer is a polyethylene oxide.

15. A method as recited in claim 14 in which the polyethylene oxide is added in an amount ranging from about 0.05 to about 2 lbs. and alum is added in an amount ranging from about 10 to about 80 lbs., each per short ton of dry pulp in said furnish.

16. A method as recited in any one of claims 1–7, inclusive, in which, following the adsorption of pitch onto said composite substance, a paper sheet containing finely-dispersed pitch-containing aggregates is produced from the furnish.

17. A method as recited in claim 16 in which said furnish contains greater than about 10% by weight, based on the total dry weight of pulp in the furnish, of groundwood pulp.

18. A method as recited in claim 17 in which said furnish is a newsprint furnish.

19. A method as recited in claim 8 in which, following the adsorption of pitch onto said composite substance, a paper sheet containing finely-dispersed pitch-containing aggregates is produced from the furnish.

20. A method as recited in claim 19 in which said furnish contains greater than about 10% by weight, based on the total dry weight of pulp in the furnish, of groundwood pulp.

21. A method as recited in claim 20 in which said furnish is a newsprint furnish.

22. A method as recited in claim 11 in which, following the adsorption of pitch onto said composite substance, a paper sheet containing finely-dispersed pitch-containing aggregates is produced from the furnish.

23. A method as recited in claim 22 in which said furnish contains greater than about 10% by weight, based on the total dry weight of pulp in the furnish, of groundwood pulp.

24. A method as recited in claim 23 in which said furnish is a newsprint furnish.

25. A method as recited claim 13 in which, following the adsorption of pitch onto said composite substance, a paper sheet containing finely-dispersed pitch-containing aggregates is produced from the furnish.

26. A method as recited in claim 25 in which said furnish contains greater than about 10% by weight, based on the total dry weight of pulp in the furnish, of groundwood pulp.

27. A method as recited in claim 26 in which said furnish is a newsprint furnish.

* * * * *